US009711249B2

(12) United States Patent
Martin et al.

(10) Patent No.: US 9,711,249 B2
(45) Date of Patent: Jul. 18, 2017

(54) METHOD OF IMMOBILIZING NUCLEAR WASTE

(75) Inventors: Ludovic Martin, Tourlaville (FR); Jean-Jacques Aman, Bretteville-en-Saire (FR); Vincent Bernard, Cherbourg Octeville (FR)

(73) Assignee: Soletanche Freyssinet, Rueil Malmaison (FR)

( * ) Notice: Subject to any disclaimer, the term of this patent is extended or adjusted under 35 U.S.C. 154(b) by 254 days.

(21) Appl. No.: 12/884,991

(22) Filed: Sep. 17, 2010

(65) Prior Publication Data

US 2012/0071703 A1 Mar. 22, 2012

(51) Int. Cl.

| | |
|---|---|
| ***G21F 9/30*** | (2006.01) |
| ***G21F 9/16*** | (2006.01) |
| ***G21F 9/18*** | (2006.01) |

(52) U.S. Cl.
CPC ..... *G21F 9/301* (2013.01); *G21F 9/16* (2013.01); *G21F 9/18* (2013.01)

(58) Field of Classification Search
None
See application file for complete search history.

(56) References Cited

U.S. PATENT DOCUMENTS

| | | | | |
|---|---|---|---|---|
| 2,616,847 | A * | 11/1952 | Ginell | 588/10 |
| 2,918,700 | A * | 12/1959 | Hatch | 588/9 |
| 3,093,593 | A * | 6/1963 | Arrance | 588/11 |
| 3,249,551 | A * | 5/1966 | Bixby | 588/10 |
| 4,144,162 | A * | 3/1979 | Edgar et al. | 208/13 |
| 4,775,494 | A * | 10/1988 | Rowsell et al. | 588/9 |
| 4,958,011 | A * | 9/1990 | Bade | 536/20 |
| 5,578,219 | A * | 11/1996 | Kajita | 210/730 |
| 5,599,916 | A * | 2/1997 | Dutkiewicz et al. | 536/20 |
| 6,459,010 | B1 * | 10/2002 | Carpena et al. | 588/10 |
| 7,091,393 | B2 * | 8/2006 | Chekhmir et al. | 588/2 |
| 7,309,437 | B2 * | 12/2007 | Cuero et al. | 210/682 |
| 2006/0277632 | A1 * | 12/2006 | Carr et al. | 800/284 |
| 2007/0112241 | A1 * | 5/2007 | Krekeler et al. | 588/9 |
| 2009/0200512 | A1 * | 8/2009 | Biscan et al. | 252/182.12 |
| 2009/0305885 | A1 * | 12/2009 | Yamada et al. | 502/414 |

FOREIGN PATENT DOCUMENTS

| | | |
|---|---|---|
| KR | 842769 | * 7/2008 |
| WO | 9529250 | * 11/1995 |

OTHER PUBLICATIONS

Heron, S. Duncan, Jr. "Clay Minerals of the outcropping Basal Cretaceous Beds between the Cape Fear River, North Carolina, and Lynches River, South Carolina". Clay and Clay Minerals. 1958. 7:148-161.*
Merriam-Websters online (2013).*
Abstract of EP 001041399, Shirase, Hitoshi, et al.*
Translation of Paradas (1995).*

* cited by examiner

*Primary Examiner* — Melvin C Mayes
*Assistant Examiner* — Sheng H Davis
(74) *Attorney, Agent, or Firm* — Dentons US LLP

(57) ABSTRACT

Method of immobilizing nuclear waste comprising:
- a mixing step during which nuclear waste is mixed with a mineral composition and water,
- a drying step during which the mixture obtained in the mixing step is dried so as to form an immobilizing matrix, characterized in that the mineral composition is obtained by a manufacturing process that comprises the steps consisting of:
- preparation of a base comprising a predetermined quantity of a mineral material synthesized by at least one part of a living structure selected from the vegetable kingdom, animal kingdom and/or microorganisms; and
- treatment of said base so as to convert it into an inactivated material with a predefined texture.

18 Claims, No Drawings

METHOD OF IMMOBILIZING NUCLEAR WASTE

The present invention relates to a method of immobilizing nuclear waste by means of a matrix based on a mineral composition obtained by the preparation of a base comprising a predetermined quantity of a mineral material synthesized by at least one part of a living structure selected from the vegetable kingdom, animal kingdom and/or microorganisms.

A radioactive or nuclear waste is a radioactive material for which no use is envisaged and the dispersion of which in the environment is not permitted. Radioactive wastes cover a great variety of substances which vary in particular in their activity and their radioactive half-life, but also in their state (solid, liquid, gaseous) and their chemical composition.

Disposal of waste, and in particular waste of nuclear origin, is a major environmental problem. Nuclear waste (liquid or solid) can be contaminated on its surface and/or in its bulk.

The wastes from the nuclear industry are specific. On the one hand their activity decreases over time, and on the other hand their varied nature necessitates methods of conditioning suited to the volumes and to their activities. There are many methods for conditioning wastes from the nuclear industry.

Two principal methods of conditioning are used for nuclear waste, compaction or encapsulation.

Compaction is a method of primary conditioning where the compacted products must be conditioned in a package.

Encapsulation or immobilization of waste is a technique commonly used in the nuclear industry in which a cement or a polymer serves for immobilizing nuclear waste inside containers or as a conditioning matrix for encapsulating the nuclear waste.

Apart from its use for immobilizing bulk solid waste in containers, cementing is also used for encapsulating waste in solution or in pulverulent form, for example evaporation residues, muds from chemical treatment or ion exchange resins.

Whatever the level of contamination of nuclear wastes, they must be stored in secure installations for quite long periods, for example several hundred years. Throughout the storage time, it is necessary to guarantee the integrity of the storage package, in particular of the conditioning and of the contents, comprising the waste and the matrix.

These waste packages are subject to strict criteria, in particular regarding the matrix. The contents must be sufficiently stable and must not be subject to dispersion connected with the storage conditions.

Encapsulation with a cement is a low-cost method that is easy to implement but it is not without drawbacks. Interactions between the constituents of certain nuclear wastes and the cement matrix can lead to swelling and cracking of the package, reducing its durability.

Cementing is the technique that is most used for solid waste. The main reasons for this choice include the wide availability of the raw materials, density of the material (biological protection), mechanical strength, good knowledge of its long-term behaviour, the robustness of the method and the ease of implementation. The waste, previously compacted or loose, is generally placed in a basket, which is itself contained in a metal or concrete container; it is then immobilized with the cement, the purpose of which is to limit the risk of diffusion of the radioactive elements to the exterior, thus forming a heterogeneous encapsulation.

However, cementing cannot guarantee durability of the packages for certain nuclear wastes loaded with chemicals (sulphates etc.) or reactive or containing organic matter.

In fact, the cementing process is an exothermic process which risks causing violent reactions during mixing with certain reactive nuclear wastes.

Moreover, the cement medium has an alkaline pH of the order of 13 to 14 which may not be compatible with certain nuclear wastes.

Furthermore, the encapsulation of reactive materials generates gases, making it impossible to guarantee the integrity of the package over long periods, for example periods of at least 300 years.

Thus, one of the purposes of the present invention is to propose another solution for immobilizing nuclear waste that does not have the drawbacks of the solutions of the prior art.

The invention therefore proposes a method for immobilizing nuclear waste comprising:

- a mixing step, during which the nuclear waste is mixed with a mineral composition and water,
- a drying step, during which the mixture obtained in the mixing step is dried so as to form an immobilizing matrix, wherein the mineral composition is obtained by a manufacturing process that comprises the steps consisting of:

- preparing a base comprising a predetermined quantity of a mineral material synthesized by at least one part of a living structure selected from the vegetable kingdom, animal kingdom and/or microorganisms; and
- treating said base so as to convert it into an inactivated material with a predefined texture.

Advantageously, the method of immobilization according to the invention makes it possible to immobilize chemically loaded nuclear waste and/or reactive metallic nuclear waste and/or organic nuclear waste which cannot be immobilized by conventional cementing.

A method of immobilization according to the invention can further comprise one or more of the following optional features, considered individually or according to all possible combinations:

the mineral composition is selected in such a way that, mixed with water, it has a pH between 11 and 12.5, for example between 11 and 12;

the mineral composition is selected so that the reaction between said mineral composition and water is more or less athermal;

the ratio of the quantity by weight of the mineral composition to the quantity by weight of water is greater than or equal to 1, for example greater than or equal to 1.5, and less than or equal to 85/15;

the mineral composition is selected in such a way that the immobilizing matrix has an 8-day compressive strength greater than or equal to 8 MPa;

during the mixing step, sand can be added so that the ratio of the quantity by weight of the mineral composition to the quantity by weight of sand is greater than or equal to 1.5 and less than or equal to 10;

the mixing step comprises:

- a premixing step during which the mineral composition and water are mixed,
- a kneading step during which the mixture obtained during the premixing step is kneaded, and
- an injection step during which the kneaded mixture is injected into a packaging containing the waste to be immobilized;

the mixing step comprises:

a premixing step during which the nuclear waste, the mineral composition and water are mixed, a kneading step during which the mixture obtained during the premixing step is kneaded, and an injection step during which the kneaded mixture is injected into a packaging intended to contain the nuclear waste.

the mineral composition comprises at least 50% and at most 80% by weight of calcium carbonate;

the mineral composition comprises at least 10% and at most 30% by weight of silica;

the quantity by weight of nuclear waste in the immobilizing matrix depends on the form and the density and is greater than or equal to 10% and less than or equal to 80%.

The invention will be better understood on reading the following description, given purely by way of example.

The present invention relates to a method for immobilizing nuclear wastes that are loaded chemically or are reactive or contain organic matter, and more particularly those that cannot be immobilized with conventional hydraulic binders.

Advantageously, the method according to the invention makes it possible to perform the encapsulation of these wastes in a matrix that is homogeneous and durable and meets predefined storage criteria.

Among the nuclear wastes that can be immobilized by the method according to the invention, there may be mentioned, without this constituting any limitation: oils, resins, ion exchange resins (IERs), graphite, magnesium, uranium, aluminium, bitumen, muds, glycol water, products based on borate and sulphate, muds or concentrates containing organic matter and mixtures thereof.

According to an embodiment of the invention, the method of immobilization comprises:

a mixing step during which nuclear waste is mixed with a mineral composition and water, a drying step during which the mixture obtained in the mixing step is dried, so as to form an immobilizing matrix.

Mixing the mineral composition and water enables the mineral composition to take on a structural arrangement leading to the creation of a three-dimensional network. Creation of this network leads to a weight gain of the hydrated mineral composition around the nuclear waste which, after a certain drying time, makes it possible to obtain a compact mass composed of the waste and an immobilizing matrix.

The mineral composition used in the method according to the invention is obtained by a manufacturing process that comprises the steps consisting of:

preparation of a base comprising a predetermined quantity of a mineral material synthesized by at least one part of a living structure selected from the vegetable kingdom, animal kingdom and/or microorganisms; and treatment of said base so as to convert it into an inactivated material with a predefined texture.

Documents FR9405013, FR9504830, FR9504831, FR9504832 and WO95/29250 describe examples of mineral compositions that can be used in the method according to the invention.

According to an embodiment of the invention, the mineral composition used in the method according to the invention is a mineral composition obtained by a manufacturing process that comprises the steps consisting of:

preparation of a base comprising a predetermined quantity of a mineral material synthesized by at least one part of a living structure selected from the vegetable kingdom, animal kingdom and/or microorganisms; and treatment of said base so as to convert it into an inactivated material with a predefined texture.

Within the meaning of the invention mineralizing, mineralized or mineralizable "living structure" is to be understood as meaning any cellular structure or structure of cellular origin, vegetable, animal or from a microorganism, living and/or resulting from life and/or compounds of biological origin, crystallized or non-crystallized, such as enzymes, hormones, proteins, DNA.

By "inactivated material" is meant material devoid of any biological and/or biomineralizing activity, in particular any pathogenic microbiological activity.

Within the meaning of the invention, the term "mineral" must be understood here in the broad sense, namely as including a mineral in its composition.

The step of preparation of the base can comprise a phase consisting of cultivating the aforementioned living structure for a period of time and in a medium such that at least a proportion of said "mineral biomass" of said material is then produced or synthesized by this structure.

The treatment step can then comprise a phase of inactivation of the living structure. By "inactivation" is meant obtaining inactivated material, as defined above, from a living structure as defined above.

A kneading phase can be performed during one of the steps of the manufacturing process.

Preferably, this kneading phase is carried out, at least partly, simultaneously with another phase of the method according to the invention, for example during inactivation or after the mixing step.

The manufacturing process can be implemented with microorganisms and/or cells, of vegetable or animal origin, alone, or in symbiotic association or some other form of association, which are mineralized, mineralizing or mineralizable.

The aforementioned living structure can be a plant and/or animal or part of a plant and/or animal such as a cell, a tissue or an organ.

From the vegetable kingdom, it is possible to use either higher plants, dicotyledons, monocotyledons, or lower plants: thallophytes or microorganisms.

Depending on circumstances, the structure selected is cultivated in vivo, in soil, on a layer rich in organic matter, by hydroponics, in a Petri dish, in a reactor such as a fermenter or by raising in batteries, on stands or fish farming, in particular.

The structure can be cultivated in a suitable nutrient medium known to a person skilled in the art such as Knopli liquid, Earle's solution, Hanks' solution, so-called "199" medium, Sabouraud medium, MEM-Eagle's medium or similar.

The step of preparation of the base can comprise a phase consisting of harvesting and/or collecting the aforementioned living structure, and incorporating it in the base in proportions such that this addition constitutes at least a proportion of the mineral material required.

The mineral material thus harvested and/or collected can be of varying nature: carbonated, siliceous, saline, fluorinated, barytic, carbon-containing, ferruginous, in the form for example of a deposit, current and/or fossil concretions. It is then incorporated in the base, either during the preparation step, or during the treatment step.

Fossil sedimentary rocks and/or others such as granite, basalt, pumice stone or others can be included in the composition of the final material.

During a possible phase of the manufacturing process, at least one from the aforementioned biomass, base, material and/or mineral matter is fragmented during the preparation step, and/or during the treatment step.

The aforementioned fragmentation is carried out at least partially by disruption by means of ultrasound and/or physicochemical means, such as the addition of additives, irradiation, cryogenic and/or thermal treatment, grinding or variation of pressure.

One of the phases of the method can comprise preparing a suspension of the aforementioned biomass, base or material in a liquid, preferably aqueous for spraying or application by brush for example. This liquid can be included in the composition of one of the aforementioned culture media.

It is possible to incorporate, during a phase of the method, a colouring matter of a predetermined shade, in at least one selected from the culture medium, the biomass, the material, the base and the mineral matter.

An optional phase of the preparation step and/or of the treatment step consists of incorporating an agent for cohesion and/or texture, in at least one selected from the biomass, the medium, the material, the base and the mineral matter.

This agent for cohesion and/or texture is preferably metallic such as calcium, magnesium, silicon, barium, sodium, fluorine, aluminium, iron, manganese, zinc, or organic such as collagen, mucopolysaccharide and/or polycellulosic compound.

Advantageously, the proportions and the composition of the aforementioned texturizing agent are selected so that the final material has a predetermined hardness and/or elasticity.

Moreover, the manufacturing process can comprise a phase of complete or partial dehydration of the inactivation salt or salts making up the aforementioned base and/or mineral matter.

This dehydration phase can be carried out at least partially by filtration, centrifugation, thermal and/or cryogenic treatment.

It can be envisaged, according to the manufacturing process, that the phases of inactivation, of dehydration and of fragmentation are at least partially carried out simultaneously.

During one of the phases or steps of the manufacturing process, an additive, for example foam-forming, fibrous, agglomerating, insulating, fireproofing or similar can be incorporated in the aforementioned base and/or mineral matter.

The following classification gives non-limitative examples of structures that can be selected for application of the invention:

a) Among the Dicotyledons:

Cells of the order Daucales, of the family Araliaceae, genus *Hedera* including *Hedera* helix;

Cells of the order Arales, genus *Rhaphidophora*, species *Syngonium podophyllum* (Schott), "*Albolineatum*", species *Syngonium auritum* syn. *Philodendron trifolium* and species *Syngonium hastifolium;*

Cells of the order Solanales, family Bignoniaceae, species *Catalpa bignonioides* where it is calcium oxalate in octahedral form, "in sea urchins", present in abundance in the cells of the petioles, for example.

Any plant cell, even one that would be poorly symbiotic, can be mineralized and/or supermineralized by the method that we have just presented, if brought in contact with said microorganisms.

This is true of the aforementioned cells, but also of all plant cells obtained for example from scrub in the form of chips or sawdust, and which are petrified by this method or are converted to tufa-type and/or travertine-type stone.

b) Among the Monocotyledons:

Cells of the order Pandarales, including those of the family Typhaceae;

Cells of grasses, including those of the Lemnaceae.

c) Among the Ferns:

The epidermis of *Equisetum arvense* (common horsetail) is the site for the production of silica minerals which are often regarded as concretions originating from epidermal membrane secretions, whereas bacteria at the periphery and/or within the cells of *Equisetum arvense* are involved in this. The latter explain the intracellular and/or extracellular silica deposits. The siliceous covering of the sterile aerial shoot of *Equisetum arvense* and the deposits of opaline silica encrusting the epidermis of its various aerial organs is associated with the presence and symbiotic involvement of bacteria. They are bacilli from 0.4 to 0.7 microns in length and 0.1 micron across. These mineralizing bacilli cause a progressive external thickening of the cells involved as the bacterial films develop. These successive films produce a homogeneous and stratified siliceous covering.

d) Among the Algae:

Biomineral masses resulting from the multiplication and accumulation of frustules of algae, naturally or industrially, are applicable to the invention.

There may be mentioned for example:

The Rhodophyceae, principally the Nemalionales, the Solenoporaceae and the Corallinaceae (comprising the Lithothamnium, the Melobesieae);

The Chlorophyceae with the Siphonales (comprising the Codiaceae including *Halimeda*) and the Dacycladales (comprising the Dacycladaceae including *Acetabularia*);

The Charophyceae with the Characeae including *Cladophora* and *Vaucheria;*

The Schizophyceae with the Porostromata and the Spongiostroma, from which *Rivularia, Oscillatoria, Phormidium, Chroococcus* and *Gleocapsa* can be selected.

e) Lichens:

The biomineral mass can also result from the culture of a tripartite plant association of the lichen type. The Lichens are composite plant associations. The "mutually beneficial" association consists of a fungus, an alga and mineralizing bacteria similar to those discussed above.

These bacteria contribute to complex, pigmented mineral incrustations within the mycelium.

The existence of deposits of lichenic acids in the form of hydrophobic extracellular crystals is due to the mineralization of the lichens by said symbiotic bacteria. The symbiotic bacteria differ from the cyanobacteria, which are sometimes cited, by their small size and the absence of pigment.

The living structure can therefore quite simply be the cells of a plant physiologically equipped in this way.

f) Among the Fungi:

The structure of vegetable origin can be a lower plant selected from the fungi and their spores.

g) Among the Microorganisms:

The living structure can be a microorganism such as a virus or bacterium including *Bacillus megaterium, Pseudomonas fluorescens, Pseudomonas maltophilia, Pseudomonas putida, Buttiauxella agrestis, Rhodococcus, Serratia marcescens.*

The use of a virus as living structure can be envisaged.

The living structure can also be an animal, or a part of an animal such as a cell, a tissue and/or an organ, selected from the invertebrate Protozoa or Metazoa such as the Porifera, the Lamellibranchia and the Echinodermata, or from the vertebrates.

One or more compatible, symbiotic or cooperative living structures can be cultivated within one and the same medium, whether they are of vegetable origin, animal origin and/or microorganisms.

The first preparation step has the purpose of obtaining a mineral base, i.e. an intermediate product. Preferably, the step of preparation of the base comprises a phase consisting of cultivating the aforementioned living structure for a period of time and in a medium such that at least a proportion of said "mineral biomass" of said material is then produced or synthesized by said structure.

The second step consists of treating said base after its supermineralization, so as to transform it into deactivated or inactivated mineral matter with a predefined texture.

As an example, one or more correspondences between the following living structures and minerals and/or rocks may be selected:

Cells of *Hedera* helix correspond to Calcium oxalate/Limestone

Cells of *Ficus elastica* correspond to Calcium carbonate/Limestone

Cells of *Equisetum* correspond to Silica/Opaline/Silicified wood/Sandstone

Cells of Grasses correspond to Silica/Opaline/Silicified wood/Sandstone

Cells of Typhaceae correspond to Silica/Opaline/Silicified wood/Sandstone

Ascomycete fungus corresponds to Calcium dipicolinate/Limestone

Cells of Pectascinaceae correspond to Calcium carbonate/Limestone

Phaeophyte alga corresponds to Silica/Diatomite/Rhodophyte alga corresponds to Calcium carbonate/Limestone/Travertine Chlorophyte alga corresponds to Calcium carbonate/Limestone/Travertine Cyanophyte alga corresponds to Calcium carbonate/Limestone/Travertine Lamellibranchia mollusc corresponds to Calcium carbonate/Limestone/Conchiferous Sandstones The production of biomass obeys the usual laws of growth of living structures: it is not necessary to describe the cultivation phase in detail here.

A person skilled in the art will be able to determine, depending on the living structure to be grown, what method of culture and what medium can be used most successfully.

Thus, it is possible, depending on the type of structure selected, to make use of one of the methods that have been developed, such as culture in vivo, in soil, on a layer rich in organic matter, by hydroponics, in a Petri dish, in a reactor such as a fermenter or by raising in batteries, on stands or fish farming, in particular.

In the case of plants that preserve their integrity, conventional methods of cultivation are preferably used (in soil, in a greenhouse, hydroponics, etc).

When the aforementioned living structure is a part of a plant such as a cell, tissue or organ, the living structure can be derived from a so-called higher plant, monocotyledon, such as the Duckweeds or dicotyledon and in particular from the Daucales, the Lianas, the Bignoniaceae, the Moraceae, the Cornaceae, the Cactaceae.

For this type of structure, which for example produces a tufa-type and/or travertine-type material, it is possible to use the following culture medium:

| | |
|---|---|
| Distilled water | 1000 grams |
| Calcium nitrate | 0.71 |
| Potassium nitrate | 0.568 |
| Magnesium sulphate | 0.284 |
| Ammonium phosphate | 0.142 |
| Ferric chloride | 0.112 |
| Potassium iodide | 0.0028 |
| Boric acid | 0.0005 |
| Zinc sulphate | 0.0005 |
| Manganese sulphate | 0.0005 |

Moreover, the structure of vegetable origin can be an alga and in particular Rhodophyte, Chlorophyte, Charophyte, Schizophyte, Cyanophyte, Phaeophyte and/or a Protophyte, and other media can be envisaged.

The same is true whether the living structure is an animal, or part of an animal such as a cell, tissue and/or organ, and in particular a protozoon with an arenaceous, carbonate, siliceous or chitinous test, the mesogloea of Porifera with calcareous or siliceous spicules, cells of corals, epidermal cells of shellfish, or cells forming osseous structures in vertebrates. The mineral biomasses can be obtained by in-vitro culture of the cells, tissues and/or organs involved in mineral biosyntheses in the animal kingdom.

It is possible for example to make use of current and/or fossil coral production for producing specific limestones.

The microorganisms can also be cultivated abundantly in commercially available industrial fermenters, and in particular ultrafermenters with tangential filtration, which can provide continuous production.

One or more compatible living structures can be cultivated within one and the same medium, optionally with at least one other compatible structure of vegetable origin, animal origin and/or microorganisms.

The second step consists of treating said base after its supermineralization so as to convert it into inactivated mineral matter with a predefined texture.

In the case of production of biomass from a living structure, the treatment step then comprises a phase of inactivation of the living structure.

This inactivating phase can be carried out by adding at least one salt, for example magnesium oxide, magnesium sulphate, calcium chloride, barium chloride preferably in anhydrous form.

The biomass is stabilized, i.e. inactivated, so that all cellular development is interrupted. Such a result can be obtained by adding, in suitable proportions, one or more of the above salts, or substances having similar effects on the living structure in question.

In the case when these compounds are used, the respective proportions (by weight) of 1 part of magnesium sulphate, 0.5 part of calcium chloride, 0.5 part of barium chloride, 2 parts of magnesium oxide, preferably anhydrous, are acceptable. However, these proportions can vary, in particular in the range from 20% to 50%.

Other methods of inactivation can be used, alone or in addition, including the use of chemical compounds, in particular fluorosilicates or irradiation and heating to high temperature.

A kneading phase can be performed during one of the steps of the manufacturing process. Preferably, this kneading phase is carried out, at least partly, simultaneously with another phase of the process, and in particular during inactivation.

Two phases of inactivation can be used: one during production of the product, the other during use, for example during the mixing step of the method according to the invention.

Complete inactivation of the living structures of the base is then performed by mixing the biomass and the aforementioned salts, supplying water in sufficient quantity to ensure good mixing of the latter. As an example, the base can be added to the aforementioned salts in proportions in the range from 0.5 of base to 1 of salts, to 4 of base to 1 of salts.

One of the advantages of the manufacturing process is that the step of preparation of the base can comprise a phase consisting of harvesting or collecting either the aforementioned living structure, or sedimentary mineral material, and incorporating it in the base in proportions such that this addition constitutes at least a proportion of the mineral material required.

It is possible to collect the mineral material in the form for example of deposit, current and/or fossil concretion, and incorporate it in the base either during the preparation step, or during the treatment step.

Moreover, the living structure is selected such that its associated mineral matter contains at least one carbonated, siliceous, selenite or similar mineralogical constituent. Many other novel sources of mineral can be used according to the invention. Clearing or other agricultural operations (harvesting, including hay harvesting, harvesting of crops, grape-harvesting etc.) generate large quantities of mineralized or mineralizable or mineralizing products that are suitable for supermineralization (hay, straw, stubble etc.).

Certain industrial operations generate waste of vegetable origin, such as sawdust, which can be mineralized. There may be mentioned the cells of relatively rigid plants and particularly those of the lianas, for example *Syngonium podophyllum, Syngonium auritum* syn. *Philodendron trifolium* and *Syngonium hastifolium*. Species of ivy and fig constitute a potential source of mineral substrates. The same applies to the coastal deposits of marine algae such as Maerl (sandy calcareous-algae sediment).

During a possible phase of the manufacturing process, at least one selected from the aforementioned biomass, base, material and/or mineral matter is fragmented during the preparation step, and optionally during the inactivating treatment step.

For example, if during cultivation of a living structure mineral and/or stratified stacks are obtained, they can optionally be broken up for use in the base. Moreover, if some or all of the mineral material is constituted by solid fossils or wastes, as explained above, the massive blocks collected can be ground or fragmented.

The fragmentation phase is carried out until a specified texture or malleability is obtained. In other words, the purpose of fragmentation is to obtain a more or less crumbly material, and preferably with a specified granulometry.

The aforementioned fragmentation is carried out at least partially by disruption using ultrasound and/or physicochemical means, such as the addition of additives, cryogenic and/or thermal treatment, grinding or variation of pressure.

In this case, one of the phases of the manufacturing process can comprise preparing a suspension of the biomass or of the aforementioned fragmented material in a liquid, preferably aqueous. It is possible, during a phase of the method, to incorporate at least one selected from the culture medium, the biomass, the material, the base and the mineral matter. This substance is optionally a constituent of the biomass.

A preparation step and/or treatment step can consist of incorporating an agent that provides cohesion or texture in at least one selected from the biomass, the medium, the material, the base and the mineral matter. This agent is preferably a binder, in particular metallic, such as calcium, magnesium, silicon, barium, sodium, fluorine, aluminium, iron, manganese, zinc, or organic such as collagen, mucopolysaccharide and polycellulosic compound.

It is already understood that this agent optionally serves as an inactivating compound, in the case of a base comprising a cultivated or collected living structure.

Advantageously, the proportions and the composition of the aforementioned agent providing cohesion and/or texture are selected so that the final material has a predetermined hardness or elasticity.

During one of the phases or steps of the method, an additive, for example foam-forming, fibrous, agglomerating, insulating, fireproofing or similar, can be incorporated in the aforementioned base and/or mineral matter.

Moreover, the method can comprise a phase for at least partial dehydration of one or more components of the aforementioned base and/or mineral matter.

This dehydration phase can be carried out at least partially by filtration, irradiation, centrifugation, thermal and/or cryogenic treatment.

It is conceivable, according to the method, that the phases of inactivation, dehydration and fragmentation are, at least partially, carried out simultaneously.

According to an embodiment of the invention, the mineral composition comprises at least 50% and at most 80% by weight of calcium carbonate and at least 10% and at most 30% by weight of silica.

The mineral composition according to the invention can be in the form of divided solid, which, after incorporation of a predetermined quantity of water and a step of intimate mixing, leads to a paste called petrifying Mix.

The viscosity of the paste Mix is adjustable by adjusting the proportions of mineral composition and water.

The encapsulation matrix can be produced after intimate mixing of the mineral composition and water at ambient temperature. The fluidity of the mixture, the mechanical properties and the setting time depend on the water content. It can be adapted to the nature of the material and can be used for immobilizing nuclear waste.

Drying of the paste Mix leads to a homogeneous matrix the mechanical and chemical characteristics of which are compatible with the storage of nuclear waste.

For example, the mechanical properties of the immobilizing matrix are:

- compressive stress greater than or equal to 8 MPa, typically 25 MPa after 30 days; and/or
- absence of release of gases and sweating even under load; and/or
- shrinkage equivalent to the cement matrices; and/or
- good radiation resistance; and/or
- no change in compressive properties after irradiation of 1300 kGy.

According to an embodiment of the invention, the mixing step comprises:

- a premixing step during which the mineral composition and water are mixed,
- a kneading step during which the mixture obtained during the premixing step is kneaded, and
- an injection step during which the kneaded mixture is injected into a packaging containing the waste to be immobilized.

According to one embodiment of the invention, the mixing step comprises:

- a premixing step during which the nuclear waste, the mineral composition and water are mixed,
- a kneading step during which the mixture obtained during the premixing step is kneaded, and an injection step during which the kneaded mixture is injected into a packaging intended to contain the nuclear waste.

The invention is not limited to the embodiments described above and must be interpreted non-limitatively, and encompassing any equivalent embodiment.

The invention claimed is:

1. A method of immobilizing nuclear waste comprising:

preparing a base comprising a predetermined quantity of a mineral material synthesized by at least one part of a living structure selected from vegetable kingdom, animal kingdom, and/or microorganisms;

treating said base so as to convert it into an inactivated mineral composition with a predefined texture;

mixing nuclear waste with the mineral composition and water to obtain a mixture, which allows a weight gain of the mineral composition around the nuclear waste, and drying the mixture so as to form an immobilizing matrix, wherein the mineral composition comprises the mineral material and the living structure in an inactivated state, which is devoid of any biological and/or biomineralizing activity, wherein the mineral composition is selected so that the reaction between said mineral composition and water is substantially athermal, and wherein the inactivation of the living structure is carried out by using fluorosilicates.

2. The method according to claim 1, wherein the mineral composition is selected in such a way that, mixed with water, it has a pH between 11 and 12.5.

3. The method according to claim 1, wherein the ratio of the quantity by weight of the mineral composition to the quantity by weight of water is greater than or equal to 1 and less than or equal to 85/15.

4. The method according to claim 1, wherein the mineral composition is selected in such a way that the immobilizing matrix has an 8-day compressive strength greater than or equal to 8 MPa.

5. The method according to claim 1, wherein mixing the nuclear waste with the mineral composition and water comprises adding sand so that the ratio of the quantity by weight of the mineral composition to the quantity by weight of sand is greater than or equal to 1.5 and less than or equal to 10.

6. The method according to claim 1, wherein mixing the nuclear waste with the mineral composition and water comprises:

premixing the mineral composition and water to obtain a premixture, kneading the premixture to obtain a kneaded mixture, and injecting the kneaded mixture into a packaging containing the waste to be immobilized.

7. The method according to claim 1, wherein mixing the nuclear waste with the mineral composition and water comprises:

premixing the nuclear waste, the mineral composition and water to obtain a premixture, kneading the premixture to obtain a kneaded mixture, and injecting the kneaded mixture into a packaging intended to contain the nuclear waste.

8. The method according to claim 1, wherein the mineral composition comprises at least 50% and at most 80% by weight of calcium carbonate and at least 10% and at most 30% by weight of silica.

9. The method according to claim 1, wherein the quantity by weight of nuclear waste in the immobilizing matrix is greater than or equal to 10% and less than or equal to 80%.

10. A method of manufacturing a mineral composition for immobilizing nuclear waste, said method comprising:

preparing a base comprising a predetermined quantity of a mineral material synthesized by at least one part of a living structure selected from vegetable kingdom, animal kingdom, and/or microorganisms;

treating said base so as to convert it into an inactivated mineral composition with a predefined texture;

wherein the mineral composition comprises the mineral material and the living structure in an inactivated state which is devoid of any biological and/or biomineralizing activity, and wherein the inactivation of the living structure is carried out by using fluorosilicates.

11. The method according to claim 10, where the inactivating phase is additionally carried out by adding at least one salt.

12. The method according to claim 10, wherein the step of preparation of the base comprises a phase consisting of cultivating the living structure for a period of time and in a medium such that at least a proportion of the base of the mineral material is then produced or synthesized by the living structure.

13. The method according to claim 12, further comprising incorporating an agent that provides cohesion or texture in at least one of the culture medium, the mineral material, the living structure, and the base.

14. The method according to claim 10, wherein a kneading phase is performed to obtain a kneaded mixture during one of the steps of the manufacturing process.

15. The method according to claim 10, wherein the step of preparation of the base comprises a phase consisting of harvesting and/or collecting the living structure or mineral material, and incorporating it in the base in proportions such that this addition constitutes at least a proportion of the mineral material required.

16. The method according to claim 10, further comprising incorporating a coloring matter of a predetermined shade, in at least one of a culture medium, the mineral material, the living structure and the base.

17. The method according to claim 11, further comprising a phase of complete or partial dehydration of inactivation salt or salts making up the base and/or mineral material.

18. The method according to claim 10, wherein during one of the phases of the manufacturing process, at least one of a foam-forming additive, a fibrous additive, an agglomerating additive, an insulating additive, and a fireproofing additive is incorporated in the base and/or mineral material.

* * * * *